US010252120B2

(12) United States Patent
Ban

(10) Patent No.: US 10,252,120 B2
(45) Date of Patent: Apr. 9, 2019

(54) GOLF CLUB HEAD

(71) Applicant: Bridgestone Sports Co., Ltd., Tokyo (JP)

(72) Inventor: Wataru Ban, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 4 days.

(21) Appl. No.: 15/487,704

(22) Filed: Apr. 14, 2017

(65) Prior Publication Data

US 2017/0333766 A1 Nov. 23, 2017

(30) Foreign Application Priority Data

May 19, 2016 (JP) ..... 2016-100829

(51) Int. Cl.
*A63B 53/04* (2015.01)

(52) U.S. Cl.
CPC .. *A63B 53/0466* (2013.01); *A63B 2053/0408* (2013.01); *A63B 2053/0445* (2013.01)

(58) Field of Classification Search
USPC ..... 473/324–350
See application file for complete search history.

(56) References Cited

U.S. PATENT DOCUMENTS 5,437,456 A * 8/1995 Schmidt ..... A63B 53/04 473/290
5,626,530 A * 5/1997 Schmidt ..... A63B 53/04 473/324
5,749,795 A * 5/1998 Schmidt ..... A63B 53/04 473/329
6,224,497 B1 5/2001 Antonious
6,348,013 B1 * 2/2002 Kosmatka ..... A63B 53/04 473/329
6,398,665 B1 6/2002 Antonious
6,645,087 B2 * 11/2003 Yabu ..... A63B 53/0466 473/342
7,294,064 B2 * 11/2007 Tsurumaki ..... A63B 53/0466 473/329
8,231,481 B2 * 7/2012 Takechi ..... A63B 53/0466 473/342
8,235,841 B2 * 8/2012 Stites ..... A63B 53/0466 473/328
8,403,771 B1 * 3/2013 Rice ..... A63B 53/04 473/328

(Continued)

FOREIGN PATENT DOCUMENTS

JP 04180778 A * 6/1992 ..... A63B 53/0466
JP 06190088 A * 7/1994

(Continued)

*Primary Examiner* — Alvin A Hunter
(74) *Attorney, Agent, or Firm* — Sughrue Mion, PLLC

(57) ABSTRACT

A wood type golf club head includes a face portion, a crown portion, and a sole portion. The face portion includes an impact area, a toe-side area on a toe side with respect to the impact area, and a heel-side area on the heel side with respect to the impact area. At least one groove is formed in the toe-side area and/or the heel-side area. The depth of the groove is 0.025 mm (inclusive) to 0.508 mm (inclusive). A groove area occupancy in the toe-side area is different from a groove area occupancy in the heel-side area.

7 Claims, 5 Drawing Sheets

(56) References Cited

U.S. PATENT DOCUMENTS

| | | | | |
|---|---|---|---|---|
| 8,435,134 | B2 * | 5/2013 | Tang | A63B 53/04 473/329 |
| 8,465,380 | B2 * | 6/2013 | Horacek | A63B 53/0466 473/329 |
| 8,517,860 | B2 * | 8/2013 | Albertsen | A63B 53/0466 473/329 |
| 8,821,312 | B2 * | 9/2014 | Burnett | A63B 53/0466 473/329 |
| 8,858,360 | B2 * | 10/2014 | Rice | A63B 53/04 473/329 |
| 9,017,187 | B2 * | 4/2015 | Abe | A63B 53/0466 473/329 |
| 2015/0165283 | A1 | 6/2015 | Martens et al. | |

FOREIGN PATENT DOCUMENTS

| | | | | | |
|---|---|---|---|---|---|
| JP | 10263118 | A | * | 10/1998 | |
| JP | 11114102 | A | * | 4/1999 | |
| JP | 2001129131 | A | * | 5/2001 | |
| JP | 2002052099 | A | * | 2/2002 | |
| JP | 2002239040 | A | * | 8/2002 | |
| JP | 2003024481 | A | * | 1/2003 | |
| JP | 2004351054 | A | * | 12/2004 | |
| JP | 2005193069 | A | * | 7/2005 | |
| JP | 2006094965 | A | * | 4/2006 | |
| JP | 2007136069 | A | * | 6/2007 | A63B 53/0466 |
| JP | 2008-272271 | A | | 11/2008 | |
| JP | 2010279847 | A | * | 12/2010 | |
| JP | 2013165962 | A | * | 8/2013 | |
| JP | 2014027973 | A | * | 2/2014 | A63B 53/0466 |
| JP | 2014087570 | A | * | 5/2014 | |
| JP | 2017060900 | A | * | 3/2017 | A63B 53/0466 |

* cited by examiner

GOLF CLUB HEAD

BACKGROUND OF THE INVENTION

Field of the Invention

The present invention relates to a wood type golf club head.

Description of the Related Art

There are proposed techniques of forming grooves in a face portion of a golf club head for the purpose of improving the performance such as a frictional force (for example, Japanese Patent Laid-Open No. 2008-272271, U.S. Patent Application Publication No. 2015/0165283, U.S. Pat. Nos. 6,398,665, and 6,224,497).

In many cases, a nigh value is placed on the distance performance of a wood type golf club head such as a driver or a fairway wood, and a more stable distance performance is desired. As a method obtaining a more stable distance performance, the decrease in the carry of a shot on an off-center impact is suppressed. However, it may be structurally difficult to obtain flexure in the periphery of the corner portions of a face portion.

SUMMARY OF THE INVENTION

It is an object of the present invention to suppress the decrease in the carry of a shot on an off-center impact.

According to the present invention, there is provided a wood type golf club head comprising a face portion, a crown portion, and a sole portion, wherein the face portion includes an impact area, a toe-side area on a toe side with respect to the impact area, and a heel-side area on a heel side with respect to the impact area, at least one groove is formed in the toe-side area and/or the heel-side area, a depth of the groove is 0.025 mm (inclusive) to 0.508 mm (inclusive), and a groove area occupancy in the toe-side area is different from a groove area occupancy in the heel-side area.

According to the present invention, there is provided a wood type golf club head comprising a face portion, a crown portion, and a sole portion, wherein the face portion includes an impact area, a toe-side area on a toe side with respect to the impact area, and a heel-side area on a heel side with respect to the impact area, a plurality of grooves are formed in the toe-side area and/or the heel-side area, a depth of each groove of the plurality of grooves is 0.025 mm (inclusive) to 0.508 mm (inclusive), and a shortest distance between adjacent grooves of the plurality of grooves is less than 1.905 mm.

Further features of the present invention will become apparent from the following description of exemplary embodiments (with reference to the attached drawings).

DESCRIPTION OF THE EMBODIMENTS

First Embodiment

Figure 1A:
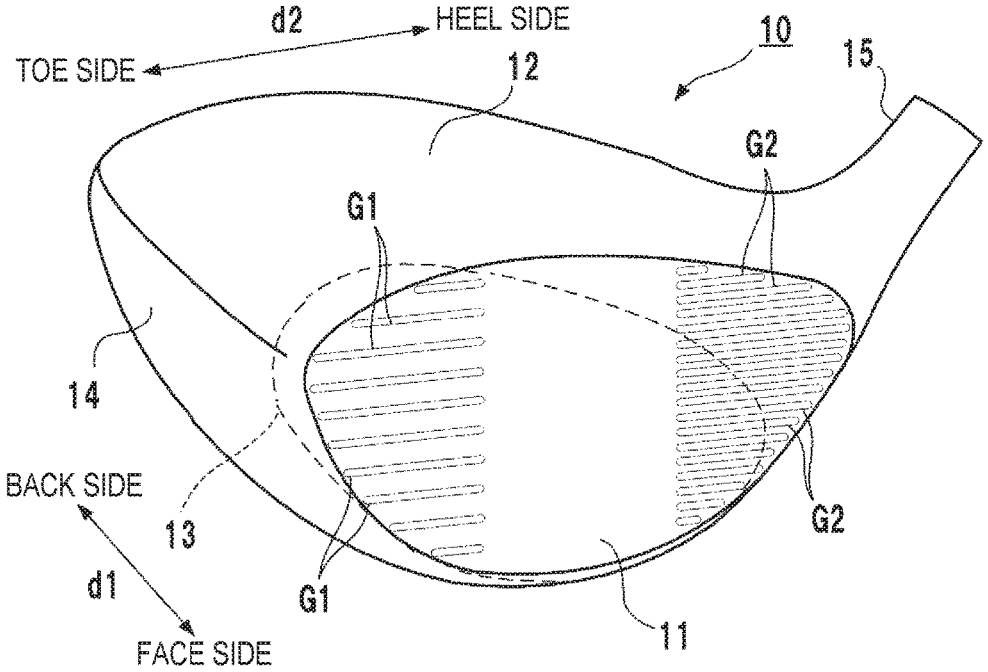
FIG. 1A is a perspective view of a golf club head according to an embodiment of the present invention.
Figure 1B:
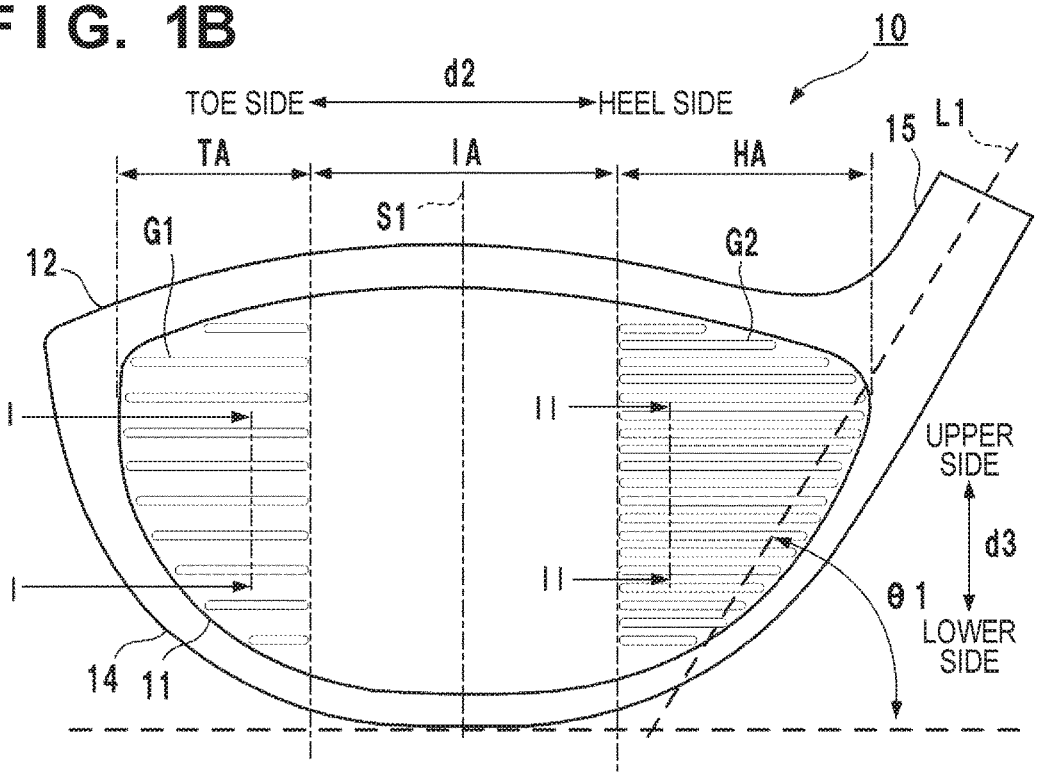
FIG. 1B is a front view showing the golf club head in FIG. 1A viewed from a face side.

FIG. 1A is a perspective view of a golf club head 10 according to an embodiment of the present invention. FIG. 1B is a front view showing the golf club head 10 viewed from the side of a face portion 11.

The golf club head 10 forms a hollow member. Its peripheral walls form the face portion 11, a crown portion 12, a sole portion 13, and a side portion 14. The surface of the face portion 11 forms a face (striking surface). The crown portion 12 forms the upper portion of the golf club head 10. The sole portion 13 forms the bottom portion of the golf club head 10. The side portion 14 forms the portion between the sole portion 13 and the crown portion 12. The golf club head 10 also includes a hosel portion 15 to which a shaft is attached.

An arrow d1 in FIG. 1A indicates a face-back direction, and an arrow d2 indicates a toe-heel direction. An arrow d3 in FIG. 1B indicates the vertical direction of the face portion 11. The face-back direction is normally a target line direction (the target direction of a shot). The toe-heel direction can be defined as, for example, a direction in which the toe-side end and the heel-side end of the sole portion 13 are connected or a direction perpendicular to the face-back direction. The vertical direction of the face portion 11 is defined based on the golf club head 10 grounded in accordance with a predetermined lie angle. In this embodiment, the vertical direction is the direction of sole portion 13 and the crown portion 12. Note that the lie angle is an angle θ1 made by a shaft axis line L1 and the ground surface, as shown in FIG. 1B.

The golf club head 10 is a golf club head for a driver. However, the present invention is applicable to various wood type golf club heads such as those of fairway woods and utility golf clubs (hybrid golf clubs) other than those of drivers.

The golf club head 10 can be made of a metal material. Examples of the metal material are a titanium-based metal (for example, a 6Al-4V-Ti titanium alloy), stainless steel, and a copper alloy such as beryllium copper.

The golf club head 10 can be assembled by joining a plurality of parts. For example, the golf club head 10 can be formed from a body member and a face member. The main body member includes the crown portion 12, the sole portion 13, the side portion 14, and a peripheral portion of the face portion 11. An opening portion is formed at a part of the portion corresponding to the face portion 11 of the main body member. The face member is joined to the opening of the main body member.

The face portion 11 includes an impact area IA, a toe-side area TA on the toe side with respect to the impact area IA, and a heel-side area HA on the heel side with respect to the impact area IA.

In a driving club or a fairway wood, the impact area IA is a band-shaped portion passing through the center of the club face and having a width of 1.68 inches (42.67 mm) under the rules (R&A rules). A supplementary description of the impact area IA will be made here with reference to FIGS. 3A and 3B as well.

Figure 3A:
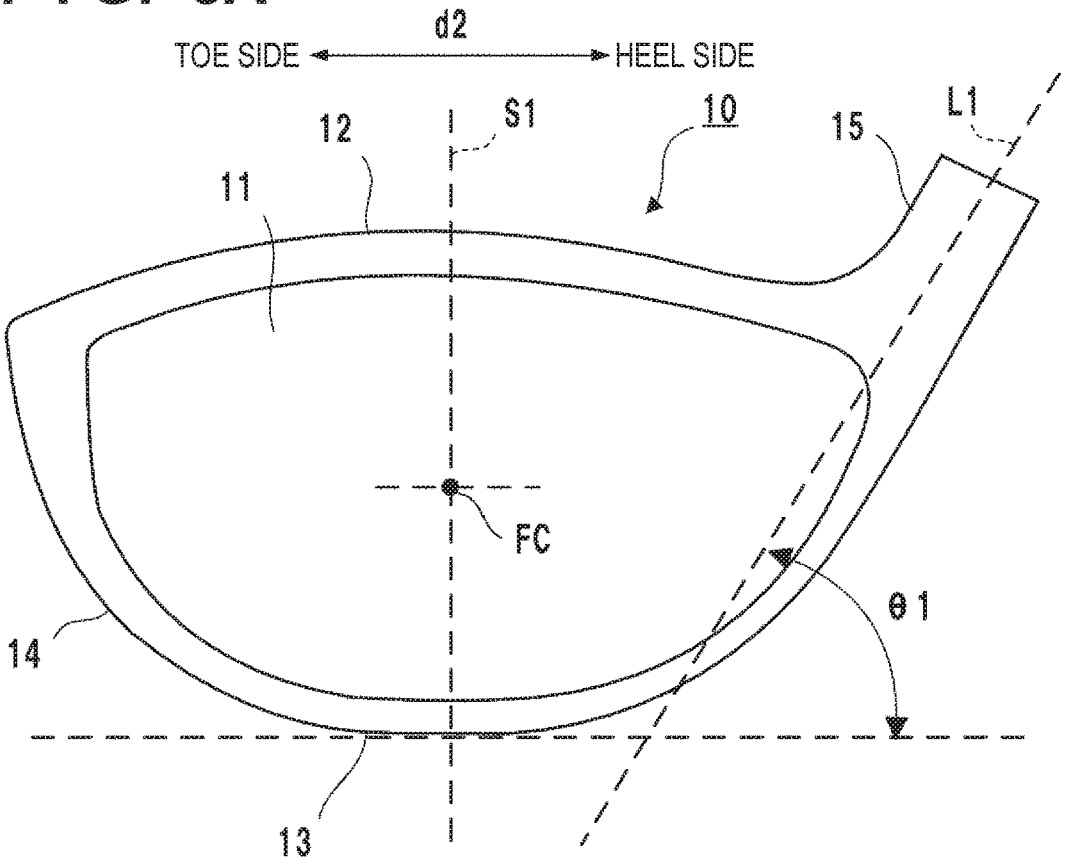
FIGS. 3A and 3B are supplementary explanatory views of an impact area.
Figure 3B:
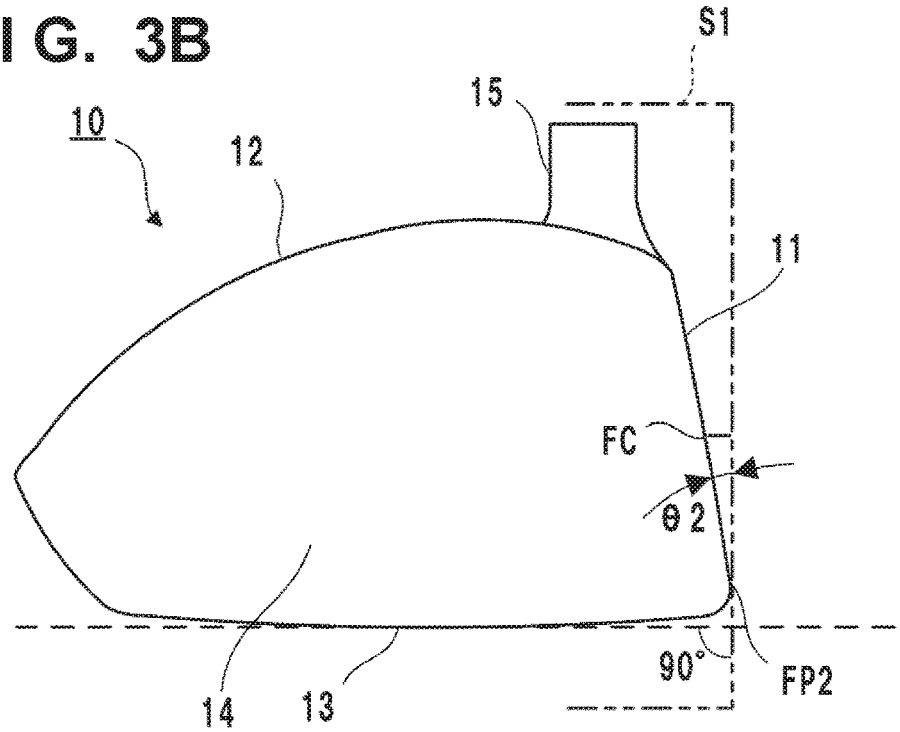

Referring to FIGS. 3A and 3B, a plane S1 is a virtual vertical plane that passes through a geometric center FC of the face portion 11 and is perpendicular to the ground surface and the toe-heel direction when the golf club head 10 is grounded at the predetermined lie angle θ1 and a predetermined loft angle θ2. As shown in FIG. 3B, the impact area IA is a band-shaped portion having a width of 1.68 inches (42.67 mm) with respect to the intersection between the plane S1 and the face portion 11 as the center. Here, a center FC of the face portion 11 can be set by the "Impact Location Template" of a pendulum test prescribed by R&A and USGA. More particularly, a position which divides the contour of the face portion 11 into halves in the crown-sole direction and in the toe-heal direction can be set as the center FC.

Figure 2A:
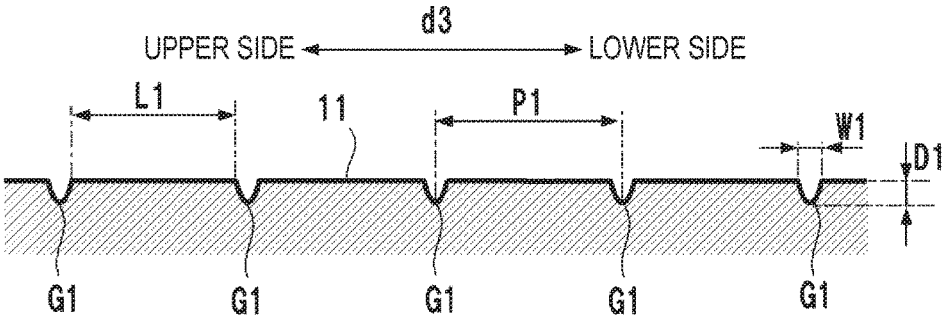
FIG. 2A is a sectional view taken along a line I-I in FIG. 1B.
Figure 2B:
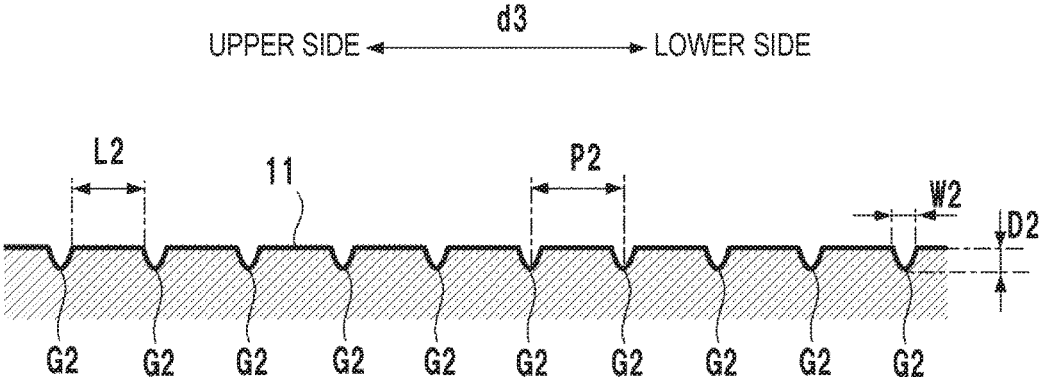
FIG. 2B is a sectional view taken along a line II-II in FIG. 1B.

Referring back to FIGS. 1A and 1B, a plurality of grooves G1 and a plurality of grooves G2 are formed in the toe-side area TA and in the heel-side area HA, respectively, on the surface of the face portion 11. In this embodiment, the plurality of grooves G1 are formed in the toe-side area TA. However, the toe-side area TA may nave a single groove G1. In the same manner, the heel-side area HA may have a single groove G2. The grooves G1 and G2 will be described with reference to FIGS. 2A and 2B in addition to FIGS. 1A and 1B. FIG. 2A is a sectional view taken along a line I-I in FIG. 1B. FIG. 2B is a sectional view taken along a line II-II in FIG. 1B. The line I-I and the line II-II are lines in the direction d3.

In this embodiment, the plurality of grooves G1 and G2 have the following configurations. The plurality of grooves G1 and G2 are arrayed in the vertical direction (direction d3) of the face portion 11. The grooves G1 and G2 are straight grooves extending in the toe-heel direction and are parallel to each other. Each of the shallow grooves G1 and G2 need not always be a straight continuous groove and may break halfway. The cross section of each of the grooves G1 and G2 has an elliptic arc outline. However, the outline shape of the cross section of each of the grooves G1 and G2 is not limited to this, and various outline shapes such as an arc shape, triangular shape, rectangular shape, and trapezoidal shape can be employed.

A depth D1 of each groove G1 and a depth D2 of each groove G2 range from, for example, 0.025 mm (inclusive) to 0.508 mm (inclusive). When the depths D1 and D2 are within this numerical range, the groove depth requirements under the rules (R&A rules) of golf club heads can be fulfilled.

The grooves G1 are formed by widths W1 and pitches P1, and adjacent grooves G1 are spaced apart by a shortest distance L1. The width W1 is the distance between the edges of each groove G1 and is a width in a direction (the d3 direction in this example) perpendicular to the longitudinal direction. The pitch P1 is the arrangement interval of each groove G1 and is the arrangement interval in the d3 direction in this example. The shortest distance L1 is the shortest distance between the edges of adjacent grooves G1 and is the separation distance in the d3 direction.

The width W1 is, for example, 0.1 mm (inclusive) to 0.9 mm (inclusive), the pitch P1 is, for example, 0.2 mm or more, and the shortest distance L1 is 0.1 mm or more. In this embodiment, the widths W1 of the grooves G1 are the same. However, the widths may be different. Additionally, the pitches P1 are the same. However, the pitches may be different. The shortest distances L1 are the same for adjacent grooves G1. However, the distances may be different. The shortest distance L1 can be less than 3 times the width W1.

The grooves G2 are formed from widths W2 and pitches P2, and adjacent grooves G2 are spaced apart by a shortest distance L2. The definitions of each width W2, each pitch P2, and each shortest distance L2 are the same as those of the grooves G1.

The width W2 is, for example, 0.1 mm (inclusive) to 0.9 mm (inclusive), the pitch P2 is, for example, 0.2 mm or more, and the shortest distance L2 is 0.1 mm or more. Although the widths W2 of the grooves G2 are the same in this embodiment, they may be different. Also, although the pitches P2 are the same in this embodiment, they may be different. Additionally, although the shortest distances L2 are the same for adjacent grooves G2, the shortest distances may be different. The shortest distance L2 can be less than 3 times the width W2.

Here, the toe-side area TA and the heel-side area HA, excluding the portions that continue from the impact area IA, are surrounded by the crown portion 12, the sole portion 13, and the side portion 14. Hence, the toe-side area TA and the heel-side area HA are restricted by the crown portion 12, the sole portion 13, and the side portion 14, and inherently, it is structurally difficult for the areas TA and HA to flex. However, in this embodiment, due to the formation of the grooves G1 and G2, the rigidity of the toe-side area TA and the rigidity of the heel-side area HA are reduced, and the areas TA and HA can flex easily. As a result, reduction in the carry of a shot can be suppressed on an off-center impact.

When the shortest distances L1 and L2 are set to be less than 3 times the corresponding widths W1 and W2, the grooves G1 and G2 are densely formed, and the toe-side area TA and the heel-side area HA can flex easily.

Next, in this embodiment, the area occupancy (to be referred to as an area occupancy A1 hereinafter) of the grooves G1 with respect to the toe-side area TA and the area occupancy (to be referred as an area occupancy A2 hereinafter) of the grooves G2 with respect to the heel-side area HA are different. The area occupancy A1 is the total area of all of the grooves G1/the area of the toe-side area TA, and the area occupancy A2 is the total area of all of the grooves G2/the area of the heel-side area HA. The areas of the grooves G1 and G2 are the areas of the regions that are open on the surface of the face portion 11. The area of each groove G1 is calculated by, for example, the width W1×the length of the groove G1. The area of each groove G2 is obtained in the same manner.

Compared to the toe-side area TA, the heel-side area HA is adjacent to the hosel portion 15 which has a nigh rigidity. Hence, it may be more difficult for the heel-side area HA to flex than the toe-side area TA. To cope with this, in this embodiment, the area occupancy A2 is made higher than the area occupancy A1. As a result, the carry of a shot will not largely change whether the impact point is in the toe-side area TA or in the heel-side area HA.

As a method of making the area occupancy A2 higher than the area occupancy A1, the pitches P2 are made shorter than the pitches P1 in this embodiment. In the examples of the drawings, the length of each pitch of the pitches P2 is half of that of the pitches P1. Accordingly, the number of the grooves G2 per unit area becomes larger than the number of the grooves G1 per unit area. Hence, the area occupancy A2 becomes higher than the area occupancy A1.

The method of changing the area occupancy A1 and the area occupancy A2 is not limited to changing the pitches P1 and P2 or the number of grooves G1 and G2. For example, it may be another method such as changing the widths W1 and W2 of the respective grooves.

In this embodiment, the area occupancy A2 is made higher than the area occupancy A1. However, conversely, the area occupancy A1 may be made higher than the area occupancy A2. This arrangement is advantageous when it is structurally more difficult for the toe-side area TA to flex than it is for the heel-side area HA or when the objective is to create a structure which allows the carry to increase when the impact point is in the toe-side area TA.

In this embodiment, no grooves corresponding to either the grooves G1 or G2 are formed in the impact area IA. However, score lines or punch marks may be formed. Furthermore, the impact area IA may nave a rough surface in compliance with the rules (R&A rules) of golf club heads.

Second Embodiment

Figure 4A:
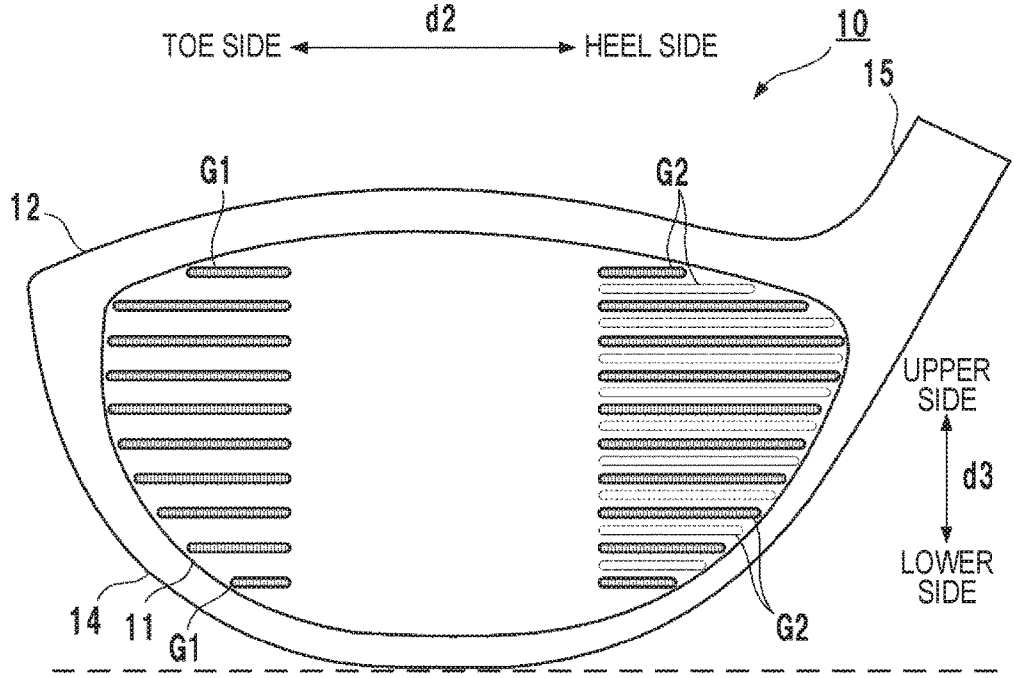
FIGS. 4A and 4B are front views of another example of a golf club head.

In the golf club head 10 according to the first embodiment, the number of grooves G2 in the heel-side area HA is higher in number than the number of grooves G1 of the toe-side area TA and is twice. Thus, when a golfer is at address, the heel-side area HA may seem more complicated than the toe-side area TA in the face portion 11. This may give the golfer a sense of discomfort. In order to reduce this discomfort, grooves G1 and G2 located at the same height as each other in a d3 direction may be colored by a predetermined color, while other grooves may not be colored. FIG. 4A shows such an example.

In the example of FIG. 4A, all of the grooves G1 are colored. For the grooves G2, only the grooves located at the same height as the grooves G1 are colored, and the remaining grooves are not colored. In the arrangement example of this embodiment, for the grooves G2, every other groove is colored. Since the presence of the colored grooves G1 and G2 is emphasized, the numbers of grooves G1 and G2 in the respective toe-side area TA and heel-side area HA seem the same to the golfer when he/she is at address. The color can be, for example, white. However, it may be another color.

Third Embodiment

In the golf club head 10 according to the first embodiment, the grooves G1 and G2 are straight grooves. However, they may nave another shape. Additionally, although the grooves G1 and G2 are arranged in the d3 direction, they may be arranged in another direction. The grooves G1 and G2 may also have different shapes or arrangement directions from each other. Grooves having different shapes or arrangement directions may also be formed in the same area.

Figure 4B:
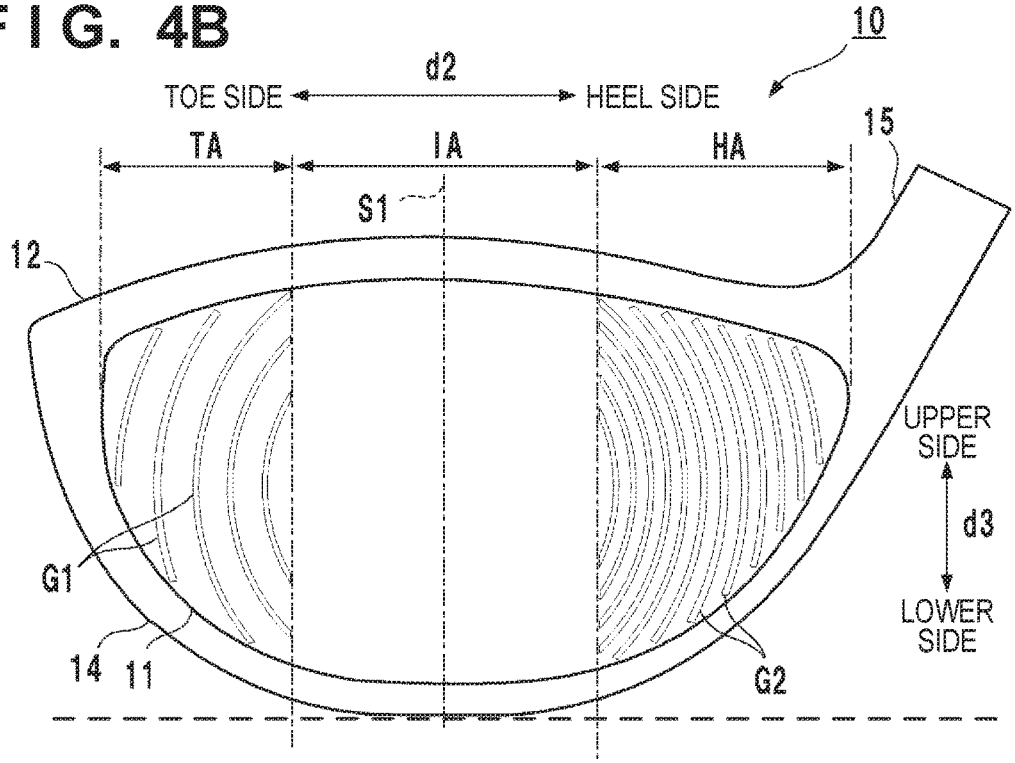

FIG. 4B shows smother arrangement example of grooves G1 and G2. In the example of FIG. 4B, a plurality of grooves G1 are formed as concentric arcs and their arrangement direction is in a d2 direction. In addition, a plurality of grooves G2 are formed as concentric arcs and their arrangement direction is in the d2 direction. In the example of FIG. 4B, the grooves G1 and G2 are concentric arcs having a common center. The grooves G1 are concentric arcs projecting toward the toe side, and the grooves G2 are concentric arcs projecting toward the heel side. However, the grooves G1 and G2 may be concentric arcs projecting in the same direction.

In some cases, it is possible to exert different kinds of influence on the spin on a shot depending on the arrangement direction of the grooves G1 and G2. Different kinds of influence can be exerted on the spin on a shot for a case in which the arrangement direction is in the d3 direction, as in the first embodiment, and for a case in which the arrangement direction is in the d2 direction, as in the example of FIG. 4B.

Fourth Embodiment

Figure 5A:
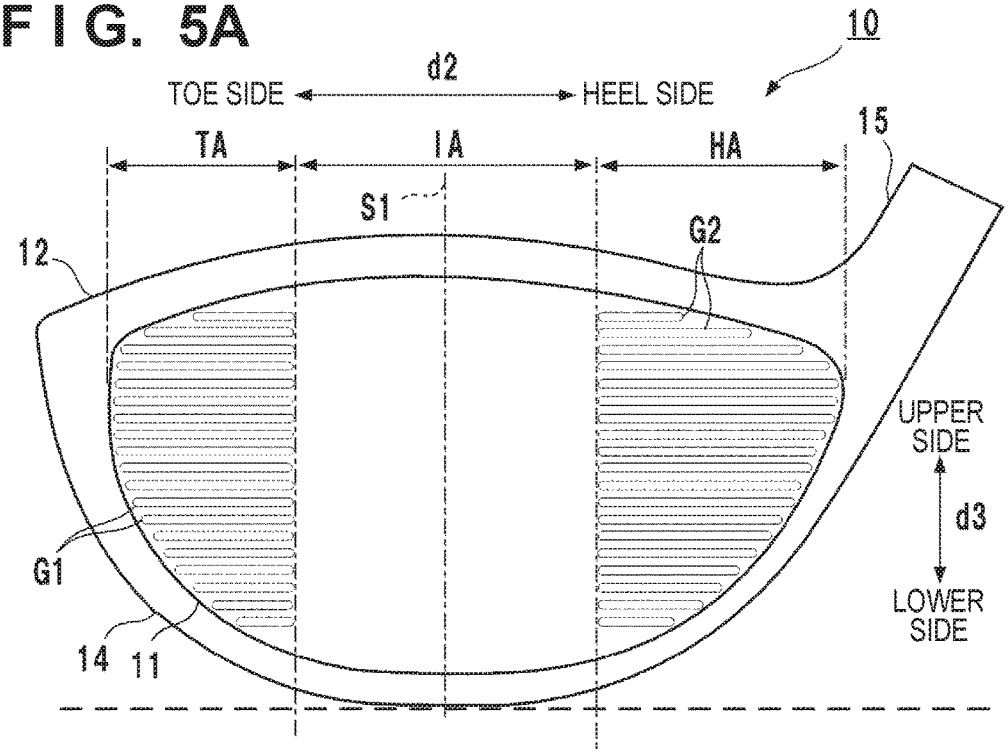
FIGS. 5A and 5B are front views of yet another example of a golf club head.

Each shortest distance L1 between adjacent grooves G1 and each shortest distance L2 between adjacent grooves G2 may be less than 1.905 mm. In this case, an area occupancy A1 and area occupancy A2 can differ from, or be equal to each other. FIG. 5A schematically shows such an example.

In the example of FIG. 5A, there are same numbers of grooves G1 and G2, and each of the respective short distances L1 and L2 is less than 1.905 mm. The shortest distances L1 and L2 can be selected from a range of, for example, 0.1 mm (inclusive) to 1.905 mm (exclusive).

In the example of FIG. 5A, since the grooves G1 and G2 are densely arranged, it can cause a toe-side area TA and a heel-side area HA to flex more easily. In some cases, a CT value (coefficient of restitution) close to that of an impact area IA or a CT value which exceeds that of the impact area IA can be partially obtained. Therefore, a decrease in the carry of a shot can be suppressed on an off-center impact. Alternatively, an off-center impact may lead to a longer carry.

Fifth Embodiment

Figure 5B:
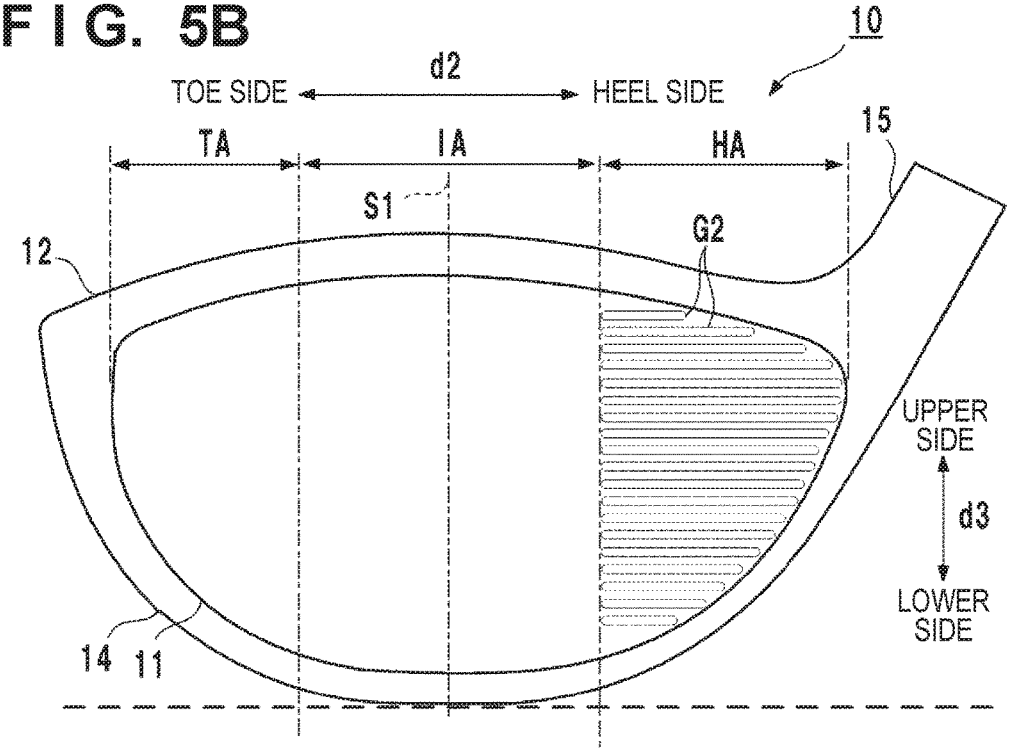

In the first to fourth embodiments, the grooves (G1 and G2) are formed in both the toe-side area TA and the heel-side area HA. However, the grooves may be formed in one of the two areas. FIG. 5B shows such an example.

In the example of FIG. 5B, grooves G2 are formed in a heel-side area HA while no grooves are formed in a toe-side area TA. In this example, when the impact point is in the heel-side area HA, the decrease in the carry of the snot can be suppressed. Contrary to the example of FIG. 5B, it is possible to adopt an arrangement in which no grooves are formed in the heel-side area HA while grooves are formed in the toe-side area TA.

Note that, in the example of FIG. 5B, an area occupancy A1 of the toe-side area TA is zero. Hence, it can be said that the area occupancy A1 and an area occupancy A2 of the heel-side area HA are different and that area occupancy A2 is higher.

Other Embodiments

The contents of the above-described first to fifth embodiments can be combined with each other.

Conformity to R&A Rules

In some cases, CT values (coefficients of restitution) of the toe-side area TA and the heel-side area HA corresponding to areas outside the impact area can exceed the regulation value (CT value of 257 μs) for areas inside the impact area. However, they can be set within the regulation value (CT value of 275 μs) for areas outside the impact area.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-100829, filed May 19, 2016, which is hereby incorporated by reference herein in its entirety.

What is claimed is:

1. A wood type golf club head comprising a striking face, a crown portion, and a sole portion, wherein the striking face includes an impact area, a toe-side area on a toe side with respect to the impact area, and a heel-side area on a heel side with respect to the impact area, at least one groove is formed in the toe-side area and/or the heel-side area, a depth of the groove is 0.025 mm (inclusive) to 0.508 mm (inclusive), a groove area occupancy in the toe-side area is different from a groove area occupancy in the heel-side area, a plurality of first grooves as the at least one groove are formed in the toe-side area, a plurality of second grooves as the at least one groove are formed in the heel-side area, and the number of the first grooves and the number of the second grooves are different from each other, whereby a groove area occupancy in the toe-side area is different from a groove area occupancy in the heel-side area.

2. The golf club head according to claim 1, wherein a shortest distance between adjacent first grooves is less than three times a width of one of the first grooves, and a shortest distance between adjacent second grooves is less than three times a width of one of the second grooves.

3. The golf club head according to claim 1, wherein a groove corresponding to the at least one groove is not formed in the impact area.

4. The golf club head according to claim 1, wherein the plurality of first grooves are straight grooves extending in a toe-heel direction and are parallel to each other, and the plurality of second grooves are straight grooves extending in the toe-heel direction and are parallel to each other.

5. The golf club head according to claim 1, wherein the plurality of first grooves are formed as concentric arcs and their arrangement direction is in a toe-heel direction, and the plurality of second grooves are formed as concentric arcs and their arrangement direction is in the toe-heel direction.

6. A wood type golf club head comprising a striking face, a crown portion, and a sole portion, wherein the striking face includes an impact area, a toe-side area on a toe side with respect to the impact area, and a heel-side area on a heel side with respect to the impact area, at least one groove is formed in the toe-side area and/or the heel-side area, a depth of the groove is 0.025 mm (inclusive) to 0.508 mm (inclusive), a groove area occupancy in the toe-side area is different from a groove area occupancy in the heel-side area, a plurality of first grooves as the at least one groove are formed in the toe-side area, a plurality of second grooves as the at least one groove are formed in the heel-side area, and a pitch of adjacent first grooves and a pitch of adjacent second grooves are different from each other, whereby a groove area occupancy in the toe-side area is different from a groove area occupancy in the heel-side area.

7. A wood type golf club head comprising a striking face, a crown portion, and a sole portion, wherein the striking face includes an impact area, a toe-side area on a toe side with respect to the impact area, and a heel-side area on a heel side with respect to the impact area, a plurality of grooves are formed in the toe-side area and/or the heel-side area, a depth of each groove of the plurality of grooves is 0.025 mm (inclusive) to 0.508 mm (inclusive), and a shortest distance between adjacent grooves of the plurality of grooves is less than 1.905 mm.

* * * * *